US007025202B2

(12) United States Patent
Jansen et al.

(10) Patent No.: US 7,025,202 B2
(45) Date of Patent: Apr. 11, 2006

(54) GOLF BAG AND LOCKING CLUB ORGANIZER

(75) Inventors: Holly Marie Jansen, Loosdrecht (NL); Johnny Ray Shealy, Greenacres, FL (US)

(73) Assignee: Club-lok B.V., Loosdrecht (NL)

( * ) Notice: Subject to any disclaimer, the term of this patent is extended or adjusted under 35 U.S.C. 154(b) by 0 days.

(21) Appl. No.: 10/769,283

(22) Filed: Jan. 30, 2004

(65) Prior Publication Data

US 2005/0061691 A1 Mar. 24, 2005

Related U.S. Application Data

(60) Provisional application No. 60/505,133, filed on Sep. 24, 2003.

(51) Int. Cl.
*A63B 55/04* (2006.01)

(52) U.S. Cl. ..... 206/315.3; 206/315.6; 70/64

(58) Field of Classification Search ..... 206/315.3, 206/315.6; 70/58, 64, 66
See application file for complete search history.

(56) References Cited

U.S. PATENT DOCUMENTS 1,717,959 A 6/1929 Cauffman
3,941,398 A * 3/1976 Nelson ..... 280/47.19
5,505,300 A * 4/1996 Joh ..... 206/315.6
5,636,735 A 6/1997 Stusek
5,775,513 A * 7/1998 Anthony ..... 206/315.3
5,918,490 A 7/1999 Lion
6,006,904 A 12/1999 Jacobsen
6,053,312 A * 4/2000 Smith ..... 206/315.6
6,062,050 A 5/2000 Lion
6,102,202 A 8/2000 Jones
6,142,319 A 11/2000 Kim
6,196,385 B1 * 3/2001 Thompson et al. ..... 206/315.6
6,381,998 B1 * 5/2002 Good ..... 70/58

* cited by examiner

*Primary Examiner*—Tri M. Mai
(74) *Attorney, Agent, or Firm*—Edward S. Wright

(57) ABSTRACT

Golf bag and locking club organizer in which a cover plate having openings for receiving the shafts of clubs and holding the clubs in a predetermined order is mounted to the top of the bag, with lock pieces pivotally suspended beneath the cover plate for swinging movement toward and away from the axes of the openings for blocking and permitting removal of the clubs from the bag, a lock plate engagable with the lock pieces and movable between first and second positions for selectively blocking or permitting movement of the lock pieces away from the axes of the openings, a lever connected to the lock plate and extending through an opening the cover plate for moving the lock plate between the first and second positions, and a lock bar movable into and out of engagement with the lock plate for retaining the lock plate in the position in which movement of the lock pieces away from the axes is blocked and the clubs cannot be removed from the bag.

24 Claims, 5 Drawing Sheets

GOLF BAG AND LOCKING CLUB ORGANIZER

CROSS-REFERENCE TO RELATED APPLICATION

This is based upon Provisional Application No. 60/505,133, filed Sep. 24, 2003.

BACKGROUND OF THE INVENTION

1. Field of Invention

This invention pertains generally to golfing equipment and, more particularly, to a golf bag and means for organizing and preventing the theft of golf clubs.

2. Related Art

Heretofore, various locking devices have been provided in order to prevent the theft of golf clubs from unattended golf bags. The majority of such devices utilize two or more relatively rotatable discs or plates with openings for the club shafts which can be selectively aligned or misaligned with each other to permit or prevent removal of the clubs from the bag. The disks or plates are generally circular, and the use of such devices is pretty much limited to golf bags having circular mouths. Examples of such devices are found in U.S. Pat. Nos. 1,717,959, 5,636,735, 5,918,490, 6,006,904 and 6,142,319.

Other devices have employed means other that rotational movement prevent removal of the clubs, and examples of such devices are found in U.S. Pat. Nos. 6,062,050, 6,102,202, 6,196,385 and 6,381,998.

OBJECTS AND SUMMARY OF THE INVENTION

It is, in general, an object of the invention to provide a new and improved golf bag and locking club organizer.

Another object of the invention is to provide a golf bag and club organizer of the above character which are effective in preventing the theft of golf clubs from the bag.

These and other objects are achieved in accordance with the invention providing a golf bag with a cover plate having openings for receiving the shafts of clubs and holding the clubs in a predetermined order, lock pieces pivotally suspended beneath the cover plate for swinging movement toward and away from the axes of the openings for blocking and permitting removal of the clubs from the bag, a lock plate engagable with the lock pieces and movable between first and second positions for selectively blocking or permitting movement of the lock pieces away from the axes of the openings, a lever connected to the lock plate and extending through an opening the cover plate for moving the lock plate between the first and second positions, and a lock bar movable into and out of engagement with the lock plate for retaining the lock plate in the position in which movement of the lock pieces away from the axes is blocked and the clubs cannot be removed from the bag.

DETAILED DESCRIPTION

Figure 1:
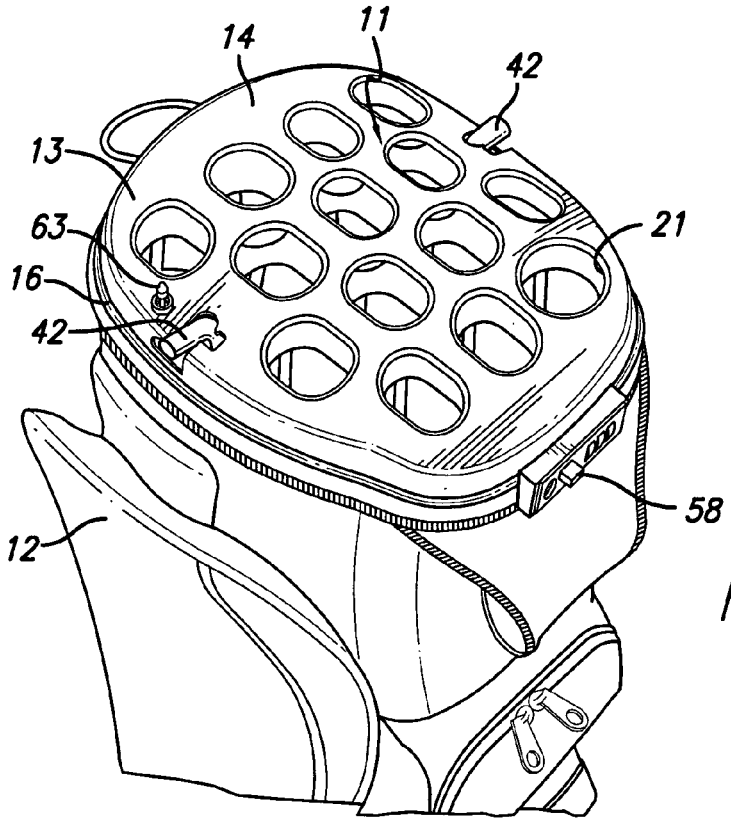
FIG. 1 is a fragmentary isometric view of one embodiment of a golf bag with a locking club organizer incorporating the invention.
Figure 2:
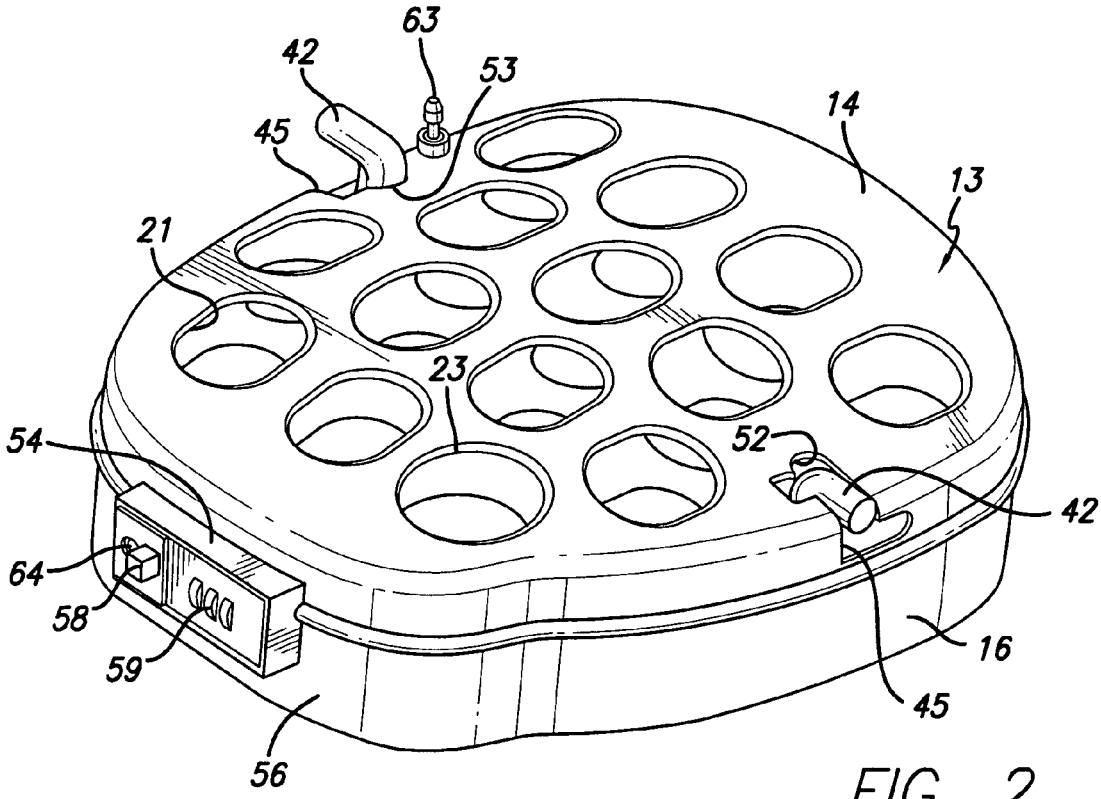
FIG. 2 is an isometric view of the club organizer in embodiment of FIG. 1.
Figure 3:
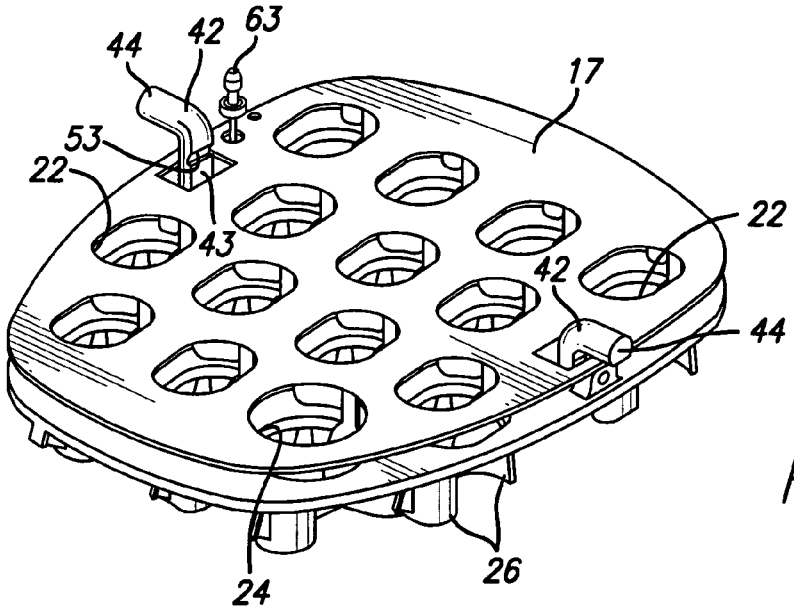
FIG. 3 is an isometric view similar to FIG. 2 with the top cover of the club organizer removed.
Figure 4:
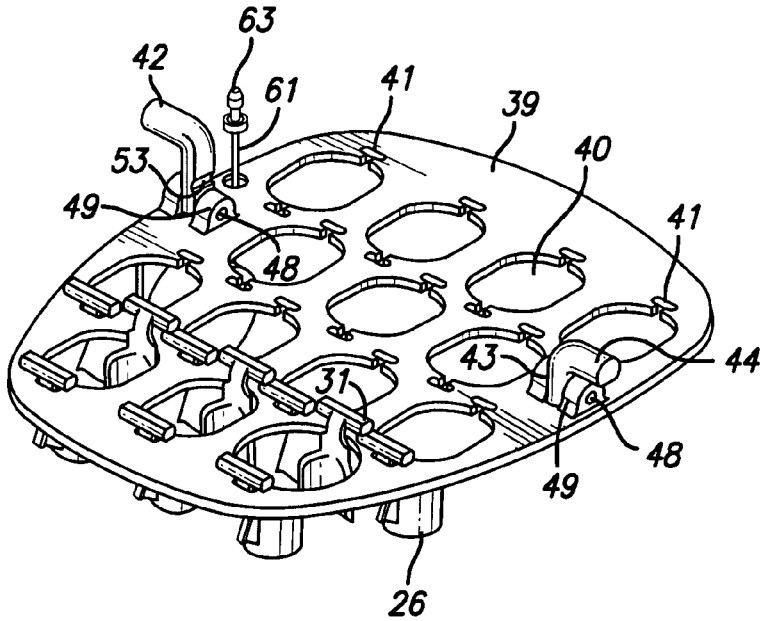
FIG. 4 is an isometric view similar to FIGS. 2 and 3 with additional parts removed.
Figure 5:
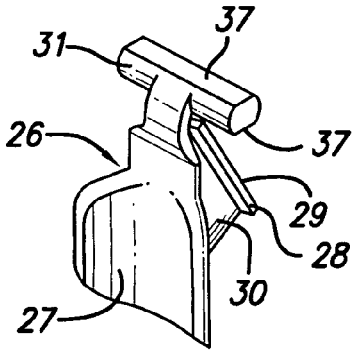
FIG. 5 is an enlarged isometric view of one of the lock pieces in the embodiment of FIG. 1.
Figure 6:
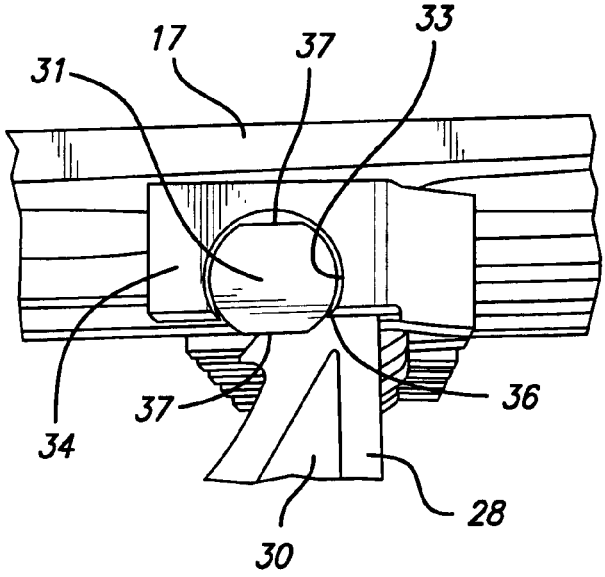
FIGS. 6 and 7 are enlarged fragmentary sectional views, illustrating the manner in which the lock pieces are mounted.
Figure 7:
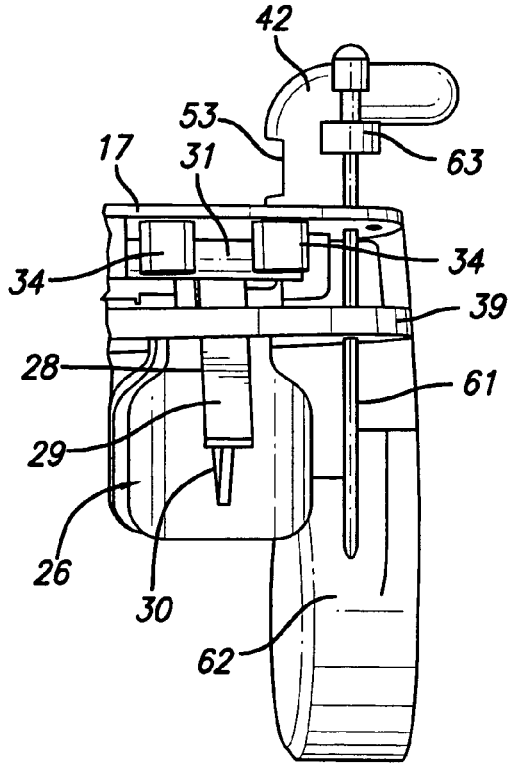
Figure 8:
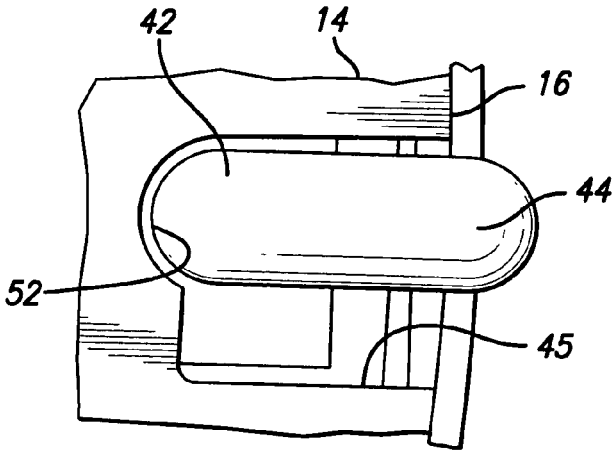
FIG. 8 is an enlarged fragmentary plan view of one of the lock plate levers in the embodiment of FIG. 1.
Figure 9:
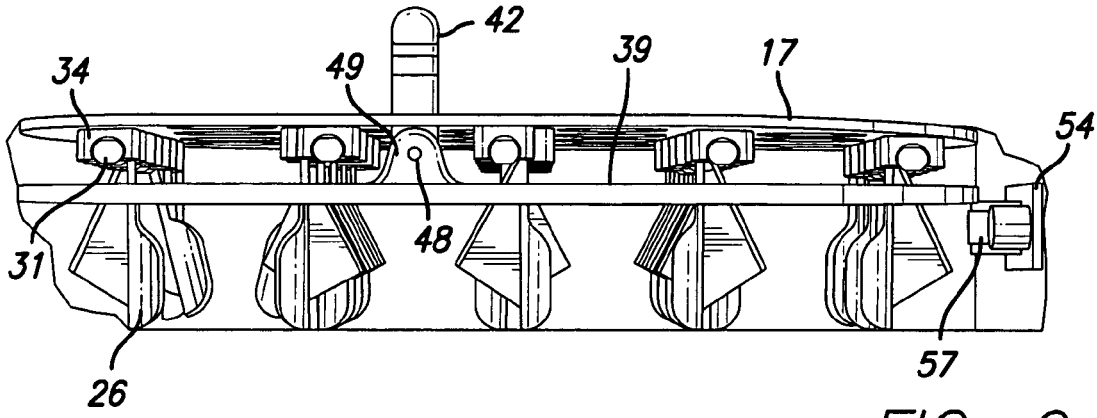
FIGS. 9 and 10 are fragmentary sectional views, illustrating the lock plate in its raised and lowered positions.
Figure 10:
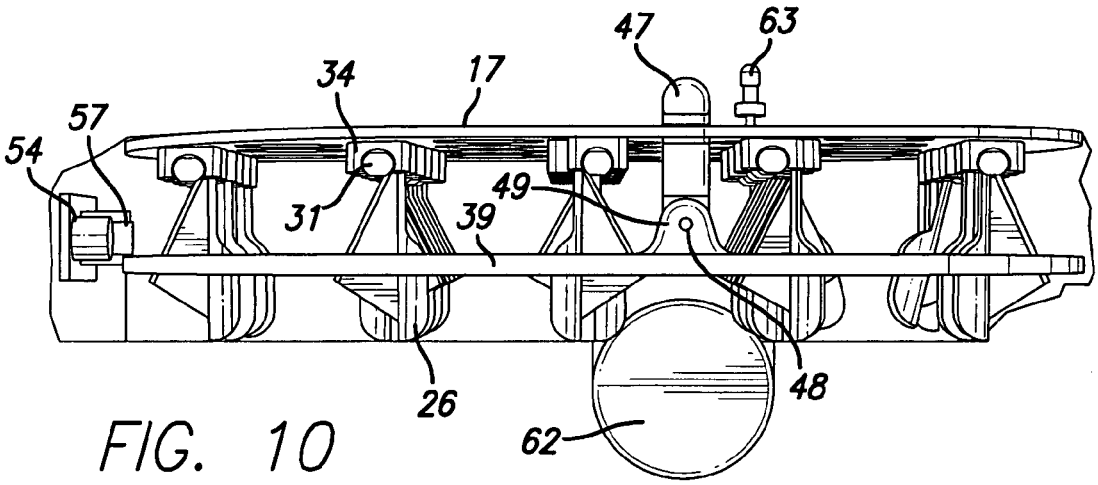
Figure 11:
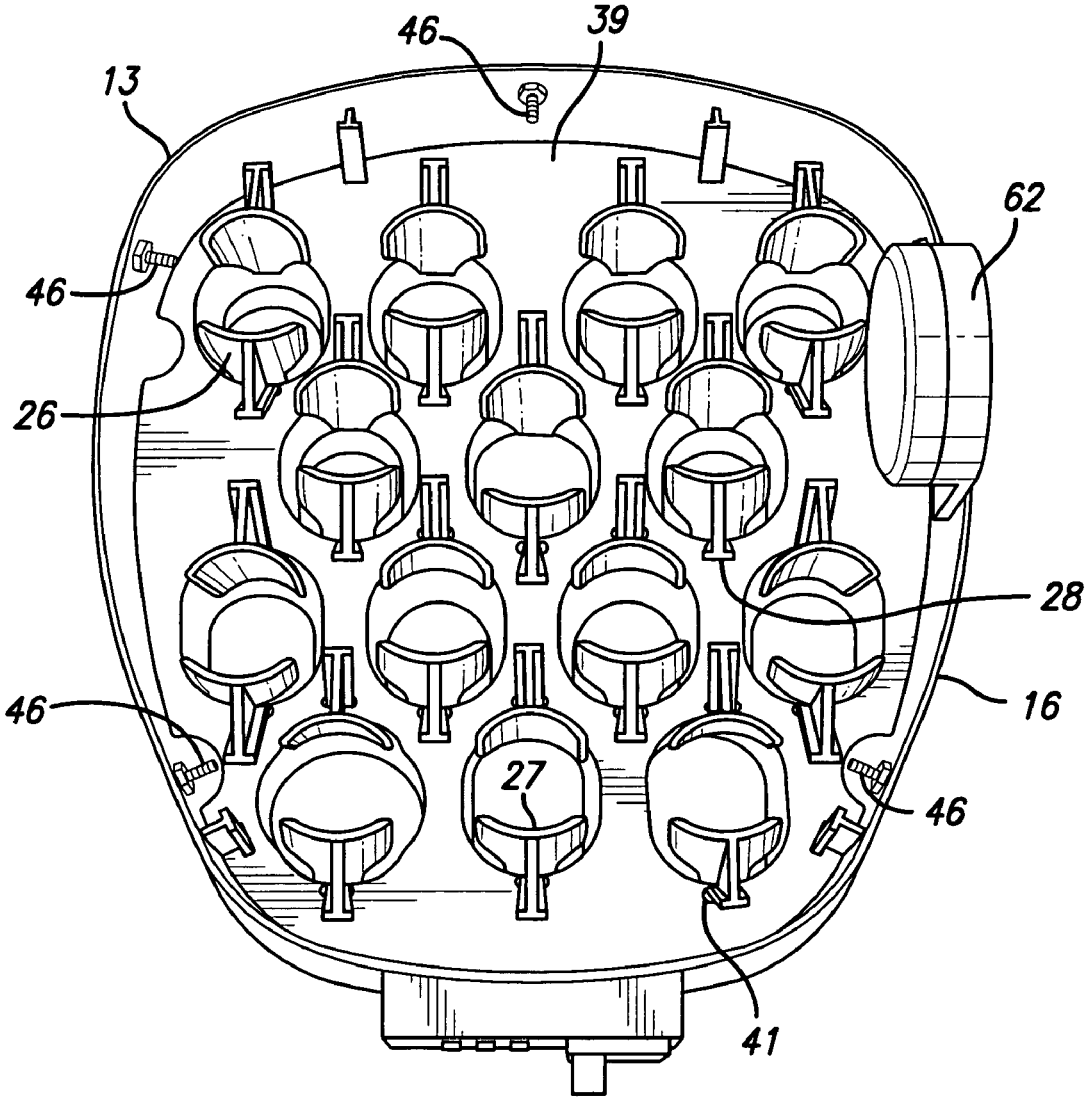
FIG. 11 is a bottom view of the club organizer in the embodiment of FIG. 1.

In FIG. 1, the club organizer 11 is illustrated in conjunction with a golf bag 12, with the organizer being mounted on the top of the bag over the compartment where the clubs are kept.

The organizer includes a cover or base plate 13 having a top wall 14 and a side wall or skirt 16. The cover plate is sized to fit over the mouth of the bag and is secured to the reinforcing ring at the mouth of the bag by rivets (not shown). A second plate 17 is mounted within the cover plate and secured in a fixed position by mounting screws received in bosses on the under side of the cover plate.

Cover plate 13 and inner plate 17 have an array of aligned openings 21, 22 for receiving the shafts of golf clubs and holding the clubs in predetermined positions within the bag. These opening are large enough to permit the shafts and the grips at the upper ends of the shafts to pass freely through them. The openings are arranged so that the clubs can be placed in the bag in a specific order, and in the embodiment illustrated, the openings 23, 24 toward one corner are larger than the other openings to accommodate putters which typically have larger grips than other clubs.

The openings in the cover can be labeled with the names of the clubs to assist in organizing the clubs. That can be done, for example, by engraving or embossing the club names or numbers into on onto the outer surface of the top wall or by imprinting them on decals or labels affixed to the wall.

Lock pieces 26 are pivotally mounted on the under side of plate 17 for swinging movement toward and away from the axes of the openings. In the embodiment illustrated, two lock pieces are provided for each pair of openings, and they are positioned on diametrically opposite sides of the openings. The lock pieces have inner faces 27 which are curved in a generally cylindrical or conical fashion, flanges 28 with downwardly and outwardly inclined outer surfaces 29, and triangular gussets 30 between the flanges and the bodies with the curved faces.

The lock pieces also have horizontally extending axles 31 at their upper ends, which are rotatively received in the bores 33 of journal blocks 34 on the under side of plate 17. The bores extend horizontally through the blocks and also open through the lower sides of the blocks. The openings 36 in the lower sides of the blocks are narrower than the axles so the lock pieces can swing back and forth in normal usage without falling out of the blocks.

The diameter of the axles is reduced in one direction to a dimension slightly less the width of openings 36 to permit the axles to be inserted into the bores. In the embodiment illustrated, the axles have flat surfaces 37 which face in upward and downward directions when the lock pieces are installed so as not to interfere with the swinging movement of the pieces. For installation, the lock piece is turned so that the reduced diameter is aligned with the opening in the block, then slipped through the opening and rotated to its operative position. In the example with the flat surfaces on the upper and lower sides of the axle, the lock piece is inserted in a generally horizontal position, then rotated through an angle of approximately 90 degrees to a vertical position.

A lock plate 39 is positioned beneath inner plate 17 and engagable with the lock pieces for retaining them in a closed or locking position. The lock plate has an array of openings 40 which are aligned with the openings in the other two plates and surround the lock pieces, with T-shaped notches 41 in which the flanges 28 of the lock pieces are received. The lock plate is movable between raised and lowered positions, with walls of the T-shaped notches engaging the flanges to control the movement of the pieces. When the lock plate is in the up position, the lock pieces are swung away from the axes of the openings, and the shafts and grips of the clubs can pass freely between them. When the lock plate is in the down position, the lock pieces are swung inwardly toward each other and prevent the grips on the clubs from passing between them.

A pair of handles or levers 42 are attached to the lock plate for moving it between its raised and lowered positions. The levers are generally L-shaped and have vertically extending lower arms 43 which are attached to the lock plate and horizontally extending upper arms 44. The levers extend through openings 45 in the top and side walls of cover plate 13 and can be grasped manually and manipulated to move the plate. Downward travel of the plate is limited by screws 46 which extend inwardly from side wall 16 of the cover plate.

The vertically extending arms of the levers are pivotally mounted to the lock plate by horizontally extending pins 48 which are received in bosses 49 on the upper side of the plate. This permits the levers to swing back and forth within the openings in the cover plate, with the levers being partially received in notches 52 along the inner edges of the openings in the rear position. These arms also have inwardly facing slots 53 which are positioned below and aligned with the upper wall of the of the cover plate when the lock plate is in the down position and up positions, respectively.

Thus, to move the lock plate from the down position to the up position, the golfer simply grasps the horizontal arms of the levers and pulls them in an upward direction. He can latch the plate in the up position by swinging the levers forward to engage the top wall within the slots in the levers. He can lower it by sliding the levers back to disengage the top wall from the slots, then pressing down on the levers or simply letting the plate drop by gravity.

Means is provided for locking the lock plate in the down position with the lock pieces in the closed position for preventing removal of the clubs from the bag. This means includes a combination lock 54 mounted on the front wall 56 of cover plate 13, with a lock bar or bolt 57 actuated by a manually operable button 58, and conventional thumb-wheels or dials 59 for latching and releasing the button.

Depressing the button extends the lock bolt relative to the lock plate, with the bolt positioned above the lock plate when the lock plate is in the down position and below the lock plate when the lock plate is in the up position. Thus, the lock plate can be locked in either the up position or the down position, depending upon whether the golfer wants to be able to remove the clubs or not.

A cable lock is also provided for securing the bag to a fixed object to prevent theft of the bag and all of the clubs. This lock includes a flexible cable 61 which is stored in a retracting storage reel 62 mounted on the underside of cover plate 13, with the free end of the cable extending through an opening in top wall 14 and terminating in tip 63 which extends from the top wall when the cable is retracted. The tip mates with and can be locked in a socket 64 in combination lock 54. Thus, the cable can be deployed by withdrawing it from the storage reel, looping it around a fixed object, inserting the tip into the socket, and locking it there. Unlocking the combination lock releases the tip from the socket so that the cable can retract onto the storage reel as well as unlatching lock bolt 57 so it can be retracted out of the path of lock plate 39. Thus, both the clubs and the bag are secured by a single lock.

In order to avoid damage to the clubs, all of the surfaces which are likely to come into contact with the shafts are coated with a relatively soft material such as an elastomer or a thermoplastic elastomer or synthetic rubber as sold, for example, under the Neoprene, Monprene or and Santoprene trademarks. The coated surfaces include the side walls of the holes in cover plate 13 and inner plate 17 and the inner faces 27 of lock pieces 26. In a particularly preferred embodiment, the plates and lock pieces are all fabricated of a plastic material and formed by a molding process, with the soft material being bonded directly to the plastic material during the molding process.

In addition, the dimensions of the lock pieces, the holes in the lock plate and the travel of the lock plate are preferably made that the lock pieces do not clamp onto the club shafts in the closed or locked position. They clear the shafts while being close enough together to prevent the grips on the upper ends of the shafts from passing between them.

It is apparent from the foregoing that a new and improved golf bag and locking club organizer have been provided. While only certain presently preferred embodiments have been described in detail, as will be apparent to those familiar with the art, certain changes and modifications can be made without departing from the scope of the invention as defined by the following claims.

The invention claimed is:

1. A golf bag having a locking organizer for golf clubs, comprising: an elongated bag having an open top, a cover plate at the top of the bag with openings for receiving the shafts of clubs and holding the clubs in a predetermined order, lock pieces pivotally suspended beneath the cover plate for swinging movement toward and away from each other for blocking and permitting removal of the clubs from the bag, each of the lock pieces having an inner face and a flange which is inclined at an angle relative to the inner face, a lock plate having slots in which the flanges of the lock pieces are received such that movement of the lock plate toward and away from the cover plate causes the lock pieces to swing toward and away from each other, means for moving the lock plate between a first position in which the lock pieces are together and prevent removal of the clubs from the bag and a second position in which the lock pieces are separated and permit removal of the clubs, and a lock for retaining the lock plate in the first position so that the clubs cannot be removed.

2. The golf bag of claim 1 wherein the means for moving the lock plate comprises a lever which is connected to the lock plate and extends through an opening the cover plate.

3. The golf bag of claim 1 wherein the lock includes a lock bar which can be moved into and out of engagement with the lock plate.

4. The golf bag of claim 3 wherein the lock bar is selectively engagable with opposite sides of the lock plate for latching the lock plate in either of its two positions.

5. The golf bag of claim 1 wherein the lever is pivotally connected to the lock plate for movement about an axis generally parallel to the cover plate and is engagable with the cover plate for retaining the lock plate in one of its two positions.

6. The golf bag of claim 1 wherein the lock includes a combination lock.

7. The golf bag of claim 6 including means controlled by the combination lock for securing the bag to a fixed object to prevent theft of the bag.

8. The golf bag of claim 1 wherein the portions of the cover plate around the openings are relatively soft so as not to damage the shafts of the clubs.

9. The golf bag of claim 1 wherein the lock pieces have horizontally extending axles which are received in blocks with horizontally extending bores.

10. The golf bag of claim 1 wherein the walls of the bores open radially through the sides of the blocks, and the axles are reduced in diameter in one direction such that they can be inserted into the bores from the sides of the blocks and rotated to an operative position in which they will no longer pass through the sides of the blocks.

11. The golf bag of claim 10 wherein the bores open through the under sides of the blocks.

12. A golf bag having a locking organizer for golf clubs, comprising: an elongated bag having an open top, a cover plate at the top of the bag with openings for receiving the shafts of clubs and holding the clubs in a predetermined order, lock pieces pivotally suspended beneath the cover plate for swinging movement toward and away from each other for blocking and permitting removal of the clubs from the bag, a lock plate engagable with the lock pieces and movable between a raised position in which the lock pieces are away from each other and a lowered position in which the plate blocks the lock pieces from moving away from each other, a pair of levers connected to the lock plate and extending through openings on opposite sides of the cover plate for moving the lock plate between the raised and lowered positions, a lock bolt movable between extended and retracted positions for engagement with the upper surface of the lock plate when the lock plate is in the lowered position and with the lower surface of the lock plate when the lock plate is in the raised position, and a lock for retaining the bolt in the extended position.

13. The golf bag of claim 12 wherein the levers are pivotally connected to the lock plate for movement about a horizontal axis and engagable with the cover plate for retaining the lock plate in the raised position.

14. The golf bag of claim 12 including means controlled by the lock for securing the bag to a fixed object to prevent theft of the bag.

15. A locking organizer for golf clubs, comprising a cover plate adapted to be mounted to the upper portion of a golf bag with openings for receiving the shafts of clubs and holding the clubs in a predetermined order, lock pieces pivotally suspended beneath the cover plate for swinging movement toward and away from each other for blocking and permitting removal of the clubs from the bag, each of the lock pieces having an inner face and a flange which is inclined at an angle relative to the inner face, a lock plate having slots in which the flanges of the lock pieces are received such that movement of the lock plate between raised and lowered positions causes the lock pieces to swing toward and away from each other, means for moving the lock plate between the raised and lowered positions, and a lock for retaining the lock plate in the position in which the lock pieces are toward each other and the clubs cannot be removed from the bag.

16. The golf club organizer of claim 15 wherein the means for moving the lock plate comprises a lever which is connected to the lock plate and extends through an opening the cover plate.

17. The golf club organizer of claim 16 wherein the lever is pivotally connected to the lock plate for movement about a horizontal axis and is engagable with the cover plate for retaining the lock plate in one of its two positions.

18. The golf club organizer of claim 15 wherein the lock includes a bolt which movable between extended and retracted positions for engagement with the lock plate.

19. The golf club organizer of claim 18 further including a combination lock for locking the bolt in its extended position.

20. The golf club organizer of claim 19 including means controlled by the combination lock for securing the bag to a fixed object to prevent theft of the bag.

21. The golf bag of claim 15 wherein the portions of the cover plate around the openings are relatively soft so as not to damage the shafts of the clubs.

22. The golf club organizer of claim 15 wherein the lock pieces have horizontally extending axles which are received in blocks with horizontally extending bores.

23. The golf club organizer of claim 22 wherein the walls of the bores open radially through the sides of the blocks, and the axles are reduced in diameter in one direction such that they can be inserted into the bores from the sides of the blocks and rotated to an operative position in which they will no longer pass through the sides of the blocks.

24. The golf club organizer of claim 23 wherein the bores open through the under sides of the blocks.

* * * * *